United States Patent [19]

Mueller

[11] Patent Number: 4,616,366

[45] Date of Patent: Oct. 14, 1986

[54] PLACKET

[76] Inventor: George B. Mueller, 3540 Chalet, Crete, Ill. 60417

[21] Appl. No.: 686,134

[22] Filed: Dec. 24, 1984

[51] Int. Cl.[4] ..... A41B 1/00

[52] U.S. Cl. ..... 2/115

[58] Field of Search ..... 2/74, 115, 96, 105, 2/118, 119, 266, 265, 106, 122, 128

[56] References Cited

U.S. PATENT DOCUMENTS

| | | | |
|---|---|---|---|
| 153,444 | 7/1874 | Maurer | 2/115 |
| 715,516 | 12/1902 | Sessions | 2/105 |
| 864,585 | 8/1907 | Worth | 2/115 |
| 885,344 | 4/1908 | Hofmeister | 2/115 |
| 1,098,638 | 6/1914 | Rees | 2/115 |
| 1,551,306 | 8/1925 | Hirsch et al. | 2/118 |
| 2,341,798 | 2/1944 | Lesser | 2/115 |
| 2,345,186 | 3/1944 | Elkes | 2/9 |
| 2,467,117 | 4/1949 | Dukes, Jr. | 2/115 |
| 2,846,687 | 8/1958 | Lippman | 2/115 |
| 4,385,403 | 5/1983 | Richardson et al. | 2/96 |

*Primary Examiner*—Doris L. Troutman

*Attorney, Agent, or Firm*—Bernard L. Kleinke

[57] ABSTRACT

A dress shirt redesigned to fit, and be put on, like a knit shirt having a partial stationary placket extending from the collar opening on the shirt and a pseudo placket extending to the bottom thereof and containing buttonholes and buttons to maintain the usual appearance of a dress shirt to prevent puckering or gapping when a person is seated or bending forwardly or a modified construction comprising the usual dress shirt provided with a two-way stretch pleat in the back of the shirt to move and stretch so as to prevent puckering or gapping when seated or bending forward.

9 Claims, 5 Drawing Figures

PLACKET

BACKGROUND OF THE INVENTION

Male (or female) persons wearing regular or traditional dress shirts find that when sitting down or bending forward the placket on the shirt has a tendency to pucker or gap as the person's position changes, thus spoiling the respectable image of neatness of a well dressed person. Even the heavily starched front of a dress shirt and placket will pucker or gap when the body's waist expands when bending forward or sitting down. It was to overcome this that the present invention was designed; to allow comfortable free movement while maintaining neat appearance in a dress use shirt.

SUMMARY OF THE INVENTION

Pullover knit shirts have a tendency to stretch around the torso of a person. This is not inherent in dress shirts made of fabric which will not stretch around the torso of a person. Thus, by applying a permanently anchored pseudo placket with buttons extending vertically as a continuation of the opening upper or usual placket on a stretch fabric, or on pleated expandable construction on the rear of the shirt, puckering or gapping is eliminated and dress shirt appearance of a well dressed person is maintained. In essence, this is a traditional dress shirt with the lower portion of the placket hiddenly sewed together so it cannot gap; made of knit material or pleated rear to facilitate putting it on.

DETAILED DESCRIPTION OF THE DRAWINGS

Figure 1:
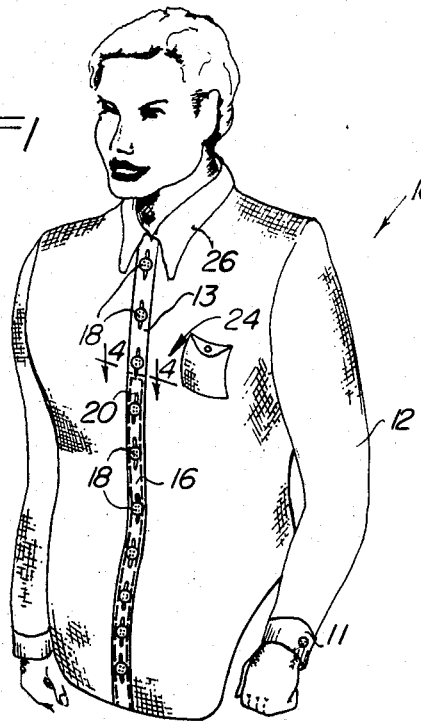
FIG. 1 is a perspective view of a dress shirt made of stretchable (knit) material having a combination stationary and pseudo placket thereon and disclosing such a shirt with long sleeves with cuffs and a cravat shown in dash lines.
Figure 2:
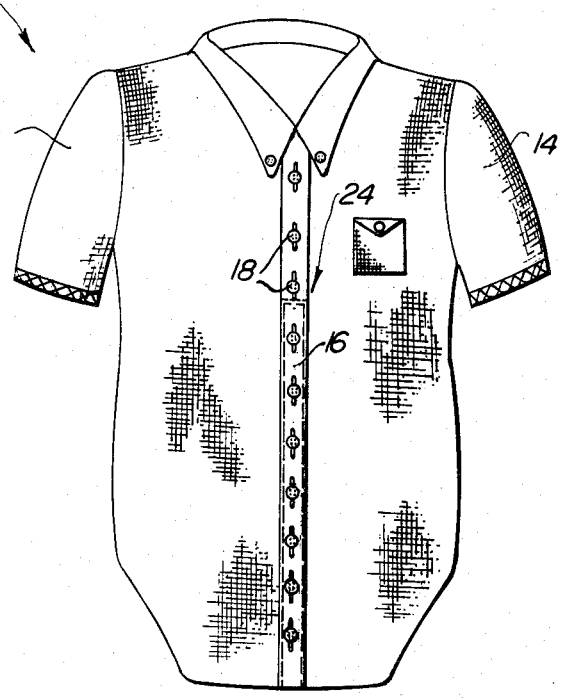
FIG. 2 is a front elevational view of FIG. 1 but illustrating the shirt with short sleeves and button down collar.
Figure 3:
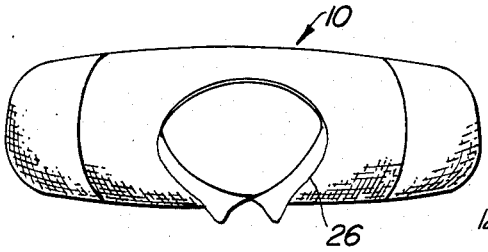
FIG. 3 is a top plan view of FIG. 1 but showing the collar buttoned.
Figure 4:
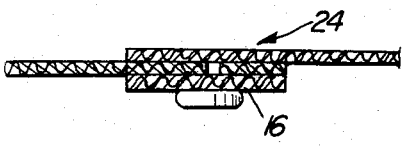
FIG. 4 is a cross-sectional view taken on the line 4—4 of FIG. 1.
Figure 5:
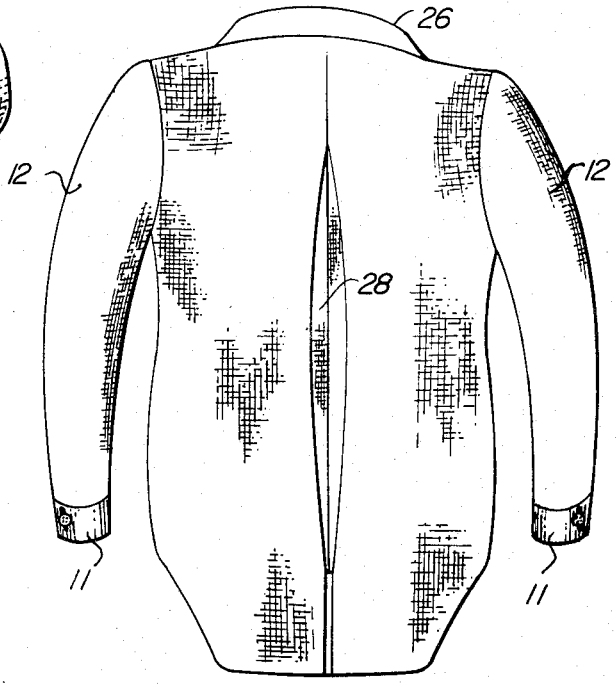
FIG. 5 is a rear view showing an alternate method of providing for expansion on a dress shirt having a two-way stretch pleat in the back of the shirt with the placket invention on the front of the shirt.

As shown in FIG. 1 of the drawings, a dress shirt 10 with long sleeves 12 with cuffs 11 is disclosed while FIG. 2 discloses the same shirt with short sleeves 14. Sport shirts are often manufactured from knit fabrics which expand and stretch more than the typical fabrics from which dress shirts are made. "Pullover knit" shirts are provided with a short placket with three or four buttons.

The invention relates to continuation of this placket into the permanent securement of a pseudo or false placket 16 on the shirt downward to the bottom thereof. The word "placket" in the shirt industry relates to the vertical portion of a shirt containing buttonholes. The placket of the instant invention is permanently secured vertically from the placket on the knit shirt to the bottom thereof.

The usual buttons 18 are sewn in the placket as if buttoned by the buttonholes 20. The pseudo placket appears to be a continuation of the existing placket on the shirt since the "stop" binding 24 prevents opening of the lower portion of the placket and this horizontal stop stitching 24 is the upper extremity of the stationary portion of the instant invention placket. This stop stitching 24 is concealed behind the continuous pseudo placket surface layer.

Now, when the newly created dress/knit shirt is pulled over the head as usual, the person would button up the upper portion of the shirt 10 as usual, including the collar 26, and when a cravat or bow tie is placed as usual under the collar and knotted, the shirt will appear as a usual dress shirt and, even as it is stretched over the torso, no amount of bending or just sitting will cause the shirt and placket to gap or pucker at the usual lower portion where it typically does "gap".

It is to be understood that the pseudo placket may be sewn or otherwise secured permanently to the shirt front as stated hereinabove.

Specifically, it is the intent to create a dress shirt that pulls over the head like a sport shirt instead of being drawn together and buttoned all the way down the center front but maintains the appearance of a dress shirt by virtue of a continuous placket. The comfort and fit and ease of movement of a sport knit shirt is provided with the appearance of a dress shirt and the added feature of a non-gapping placket. The expansion of the shirt will be provided by any of the following methods: stretch fabric, generous cut, or expanding vertical pleats as below explained.

Most normal dress shirts are usually provided with a vertical pleat in the back but this modified construction replaces the pleat with two-way stretchable material 28 which will keep the shirt snug against the torso of the body and prevent puckering or gapping when the wearer is seated or bends forward.

It will be understood that details of the construction may be altered or omitted without departing from the spirit of the invention as defined by the following claims.

I claim:

1. A shirt, comprising:

a right front side marginal edge having an upper right portion extending from a collar portion to a breast portion and a lower right portion extending from the breast portion to a waist portion;

a left front side marginal edge having an upper left portion extending from the collar portion to the breast portion and a lower left portion extending from the breast portion to the waist portion;

the upper right portion and upper left portion being separable to enable a wearer to don the shirt by slipping the shirt over the user's head, and closeable to enable a user to draw the upper right portion and upper left portion together for buttoning once the shirt is donned; and the lower right portion and lower left portion overlapping along a central line extending from the breast portion to the waist portion;

a placket extending along one of the upper right portion and the upper left portion, from the collar portion to the breast portion, and continuously from the breast portion along the center line to the waist portion, the placket having a series of spaced-apart buttonholes along substantially its entire length, the series of buttonholes including an upper group of buttonholes between the collar portion and the breast portion and a lower group of buttonholes between the breast portion and the waist portion;

a series of spaced-apart buttons corresponding to the buttonholes, the series of buttons including an upper group of buttons for engagement with the upper group of buttonholes and a lower group of buttons located at corresponding ones of the lower group of buttonholes;

placket stitching means for attaching the overlapping lower right and lower left portions together along the central line, and for attaching the placket to the lower right and lower left portions;

upper button stitching means for attaching the upper group of buttons;

lower button stitching means for attaching the lower group of buttons to the shirt, the lower button stitching means extending through the lower group of buttonholes; and traverse stop stitching means for reinforced attachment of the placket to the lower right and lower left portions along a stress line extending traversely to the central line at the breast portion;

wherein the lower right and lower left portions are permanently attached together to prevent undesired separation, while providing the appearance of a conventional front-buttoned dress shirt.

2. The shirt according to claim 1 wherein buttonholes and buttons are spacedly secured to said placket to appear as a usual placket on the shirt.

3. The pseudo dress shirt according to claim 2 wherein the placket material is permanently secured to said shirt as an extension of a usual upper placket.

4. A shirt according to claim 1 having two-way stretch material pleats on the rear of the shirt to stretch the shirt about the torso of the wearer and prevent puckering or gapping when seated or changing position.

5. The shirt recited in claim 1, wherein:

the series of buttonholes and the series of buttons are evenly spaced.

6. The shirt recited in claim 1, wherein:

the shirt is composed of a stretchable material.

7. The shirt recited in claim 1, further comprising:

a back panel having pleat means composed of two-way stretch material for enabling stretching of the shirt about the torso of a wearer to prevent puckering or gapping when the wearer is seated or changing position.

8. The shirt recited in claim 7, wherein:

said pleat means is centrally located at the back portion of the shirt.

9. The shirt recited in claim 7, wherein:

the remainder of the shirt apart from the pleat means is composed substantially of non-stretchable material.

* * * * *